US009664350B2

(12) United States Patent
Matsumoto

(10) Patent No.: US 9,664,350 B2
(45) Date of Patent: May 30, 2017

(54) VEHICLE LAMP

(71) Applicant: KOITO MANUFACTURING CO., LTD., Tokyo (JP)

(72) Inventor: Hiroki Matsumoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 32 days.

(21) Appl. No.: 14/273,716

(22) Filed: May 9, 2014

(65) Prior Publication Data

US 2014/0340922 A1 Nov. 20, 2014

(30) Foreign Application Priority Data

May 17, 2013 (JP) ..... 2013-105542

(51) Int. Cl.
*F21V 7/00* (2006.01)
*F21S 8/10* (2006.01)

(52) U.S. Cl.
CPC ..... *F21S 48/1109* (2013.01); *F21S 48/1159* (2013.01); *F21S 48/321* (2013.01); *F21S 48/325* (2013.01)

(58) Field of Classification Search
CPC . F21S 48/1159; F21S 48/1554; F21S 48/1388
USPC ..... 362/516
See application file for complete search history.

(56) References Cited

U.S. PATENT DOCUMENTS 6,843,589 B1 * 1/2005 Dhillon ..... B60Q 1/05 16/366
7,591,573 B2 * 9/2009 Maliar ..... F21S 48/1104 362/516
8,683,683 B2 * 4/2014 Knoll ..... F21V 17/06 29/739
2008/0198614 A1 8/2008 Tajima et al.
2010/0182786 A1 * 7/2010 Hein ..... F21S 8/086 362/240
2010/0253223 A1 * 10/2010 Inoue ..... F21S 48/1159 315/82
2012/0163031 A1 * 6/2012 Okada ..... F21S 48/215 362/613
2012/0256543 A1 * 10/2012 Marcove ..... B60Q 1/2607 315/77

(Continued)

FOREIGN PATENT DOCUMENTS

CN 1862087 A 11/2006
JP 2010-244726 A 10/2010

(Continued)

OTHER PUBLICATIONS

First Office Action issued in corresponding Chinese Application No. 201410157542.X, mailed on Jan. 4, 2016 (15 pages).

(Continued)

*Primary Examiner* — Andrew Coughlin
*Assistant Examiner* — Matthew Peerce
(74) *Attorney, Agent, or Firm* — Osha Liang LLP

(57) ABSTRACT

A vehicle lamp includes an optical unit and a light source control circuit part. The optical unit is unitized by attaching a light source and an optical member to an attachment part. In a state where the optical unit is unitized, the light source control circuit part is attachable to the attachment part in a direction in which the light source and the optical member are not disposed.

10 Claims, 6 Drawing Sheets

(56) References Cited

U.S. PATENT DOCUMENTS

| | | | | |
|---|---|---|---|---|
| 2012/0314436 | A1 | 12/2012 | Inoue et al. | |
| 2013/0077335 | A1* | 3/2013 | Murley | F21S 48/1104 362/517 |
| 2013/0141929 | A1* | 6/2013 | Moisy | B60Q 1/0064 362/516 |
| 2014/0098555 | A1* | 4/2014 | Tessnow | B60Q 1/04 362/518 |
| 2015/0241018 | A1* | 8/2015 | Williams | F21S 48/328 362/516 |

FOREIGN PATENT DOCUMENTS

| | | | |
|---|---|---|---|
| JP | 2013-016261 | A | 1/2013 |
| JP | 2013-020935 | A | 1/2013 |
| JP | 2013-045579 | A | 3/2013 |
| JP | 2013-054834 | A | 3/2013 |

OTHER PUBLICATIONS

Notification of Reasons for Refusal issued in corresponding Japanese Application No. 2013-105542, mailed on Apr. 4, 2017 (7 pages).

* cited by examiner

VEHICLE LAMP

CROSS REFERENCE TO RELATED APPLICATION(S)

This application is based on and claims priority under 35 U.S.C. §119 to Japanese Patent Application No. 2013-105542 filed on May 17, 2013, the entire contents of which are incorporated herein by reference.

BACKGROUND

1. Technical Field

Exemplary embodiments of the invention relate to a lamp to be mounted on a vehicle.

2. Related Art

For example, JP 2013-20935 A (corresponding to US 2012/0314436 A) describes a vehicle headlight in which a light emitting module that is configured so that a light emitting element and a control circuit part for controlling turning on/off of the light emitting element are integrated, a reflector, a projection lens, and the like are unitized and the unit is disposed in a lamp chamber.

SUMMARY

In order to form a light distribution pattern accurately, a high positioning accuracy is required for the light emitting element, the reflector, and the projection lens of the vehicle headlight described in JP 2013-20935 A. Thus, if any one of the unitized components gets out of order, the entire unit needs to be replaced.

Exemplary embodiments of the invention provide a vehicle lamp that enables replacement of only a light source control circuit part while a light source and an optical component remain unitized.

(1) According to one exemplary embodiment of the invention, a vehicle lamp includes an optical unit and a light source control circuit part. The optical unit is unitized by attaching a light source and an optical member to an attachment part. In a state where the optical unit is unitized, the light source control circuit part is attachable to the attachment part in a direction in which the light source and the optical member are not disposed.

(2) The optical member may include a lens and a reflector. The lens is disposed on a lamp front side of the light source. The reflector is disposed so as to cover an upper portion of the light source. A heat sink may be provided on an opposite side to a surface, to which the light source is attached, of the attachment part. The light source control circuit part may be disposed adjacent to the heat sink on a lamp front side of the heat sink.

(3) The optical unit and the light source control circuit part may be disposed in a lamp chamber formed by a lamp body and a transmissive cover. A portion of the lamp body corresponding to a direction in which the light source and the optical member are not disposed may be openable.

(4) A lamp-lower-side portion of the lamp body may be openable.

According to the above configuration, the light source control circuit part can be attached to and detached from the attachment part in the direction in which the light source and the optical member are not disposed. Therefore, when the light source control circuit part gets out of order, only the light source control circuit part can be replaced without disassembly of the optical unit.

DETAILED DESCRIPTION

Figure 1:
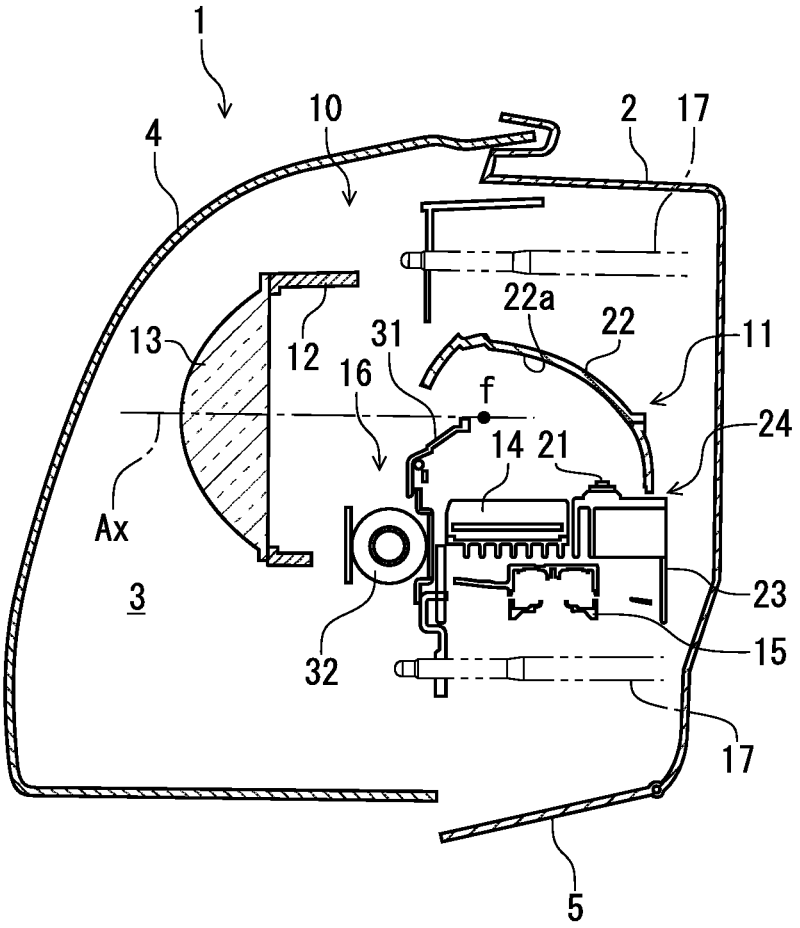
FIG. 1 is a section view of a vehicle lamp according to an embodiment of the invention.

Exemplary embodiments of the invention will be described below in detail with reference to the accompanying drawings. The drawing which will be referred to in the following description may not be shown to scale so that respective members are illustrate in recognizable sizes. Further, the terms "right" and "left" used in the following description indicate the right and the left directions viewed from the driver's seat.

FIG. 1 is a section diagram of a part of a headlight apparatus 1 (an example of a vehicle lamp) taken along a vertical plane and viewed from a side direction. The headlight apparatus 1 is a so-called PES type vehicle lamp that is mounted on a front part of a vehicle and that illuminates a forward area. The headlight apparatus 1 includes a lamp body 2 and a transmissive cover 4 that is attached to the lamp body 2 so as to define and form a lamp chamber 3. An openable part 5 is provided on a lamp lower side of the lamp body 2. A lamp unit 10 (an example of an optical unit) according to the embodiment of the invention is disposed in the lamp chamber 3.

The lamp unit 10 is attached to the lamp body 2 from the inner side of the lamp chamber 3. The lamp unit 10 includes a light source unit 11, a lens holder 12, a projection lens 13 (an example of an optical member), a light distribution control unit 16, and an aiming mechanism 17. A light source control circuit part 14 and a fan 15 are attached to the lamp unit 10 in which the above-described members are unitized.

The light source unit 11 includes a light source 21, a reflector 22 (an example of the optical member), and a heat sink 23. The light source 21 is fixed to an attachment part 24 of the light source unit 11. The reflector 22 having a dome shape is disposed so as to cover an upper part of the light source 21. An inner surface 22*a* of the reflector 22 serves as a reflecting surface and disposed to face the light source 21.

The light distribution control unit 16 is disposed on a lamp front side of the light source unit 11. The lens holder 12 is disposed on the front side of the light distribution control unit 16. The projection lens 13 is fixed to the lens holder 12. The projection lens 13 is a planar-convex aspheric lens having a planar light incident surface and a convex light output surface. Light emitted from the light source 21 is reflected forward by the inner surface 22*a* of the reflector 22. At least a part of the reflected light passes through the projection lens 13. The light having passed through the projection lens 13 goes through the transmissive cover 4 and then illuminates a forward area of the lamp.

The lamp unit 10 is attached to the lamp body 2 through aiming mechanisms 17 so as to be tiltable. The aiming mechanisms 17 are provided in upper and lower portions of the lamp chamber 3. Tip ends of the aiming mechanisms 17 are attached to the light distribution control unit 16. Further, although not shown, the other ends of the aiming mechanisms 17 are fixed to the lamp body 2 side. The aiming mechanisms 17 are used for fine adjustment of an attachment angle of the lamp unit 10 with respect to the lamp body 2. The fine adjustment of the attachment angle of the lamp unit 10 adjusts a direction of an optical axis of the light emitted from the lamp unit 10.

The light source control circuit part 14 is disposed adjacent to the heat sink 23 of the light source unit 11 on the lamp front side of the heat sink 23. Also, the fan 15 is provided in a space formed by the light source unit 11 on the lamp lower side of the light source control circuit part 14.

Figure 2:
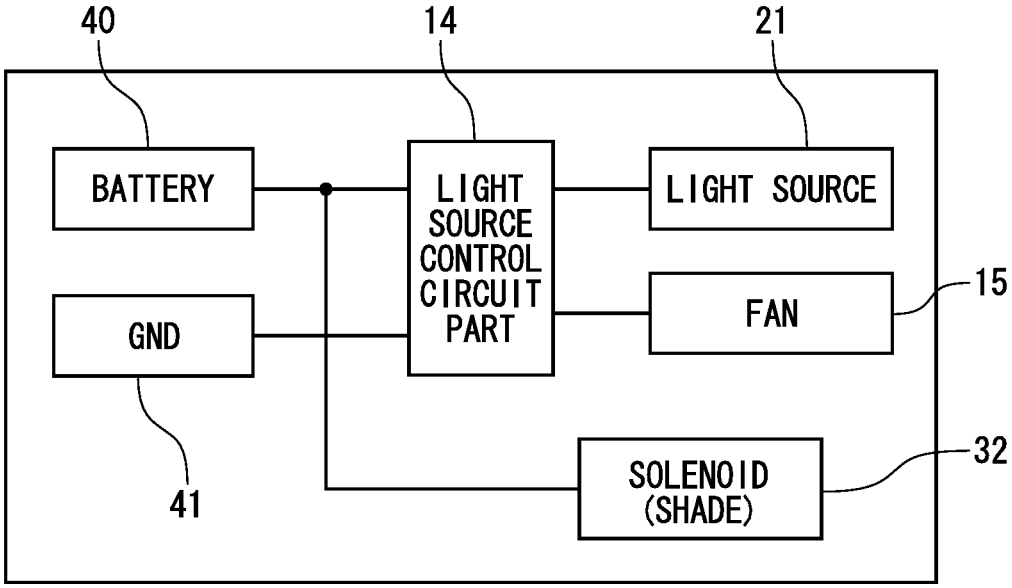
FIG. 2 is a block diagram showing the vehicle lamp of FIG. 1.

FIG. 2 is a block diagram of the headlight apparatus 1, centering on the light source control circuit part 14.

As shown in FIG. 2, the light source control circuit part 14 is electrically connected to a battery 40 that is provided inside or outside the headlight apparatus 1. The light source control circuit part 14 is grounded to a ground (GND) 41. Also, the light source control circuit part 14 is electrically connected to the light source 21 and the fan 15 and controls the turning on/off of the light source 21 and driving of the fan 15. Furthermore, a solenoid 32 (which will be described later) provided in the light distribution control unit 16 is electrically connected between the battery 40 and the light source control circuit part 14.

Figure 3:
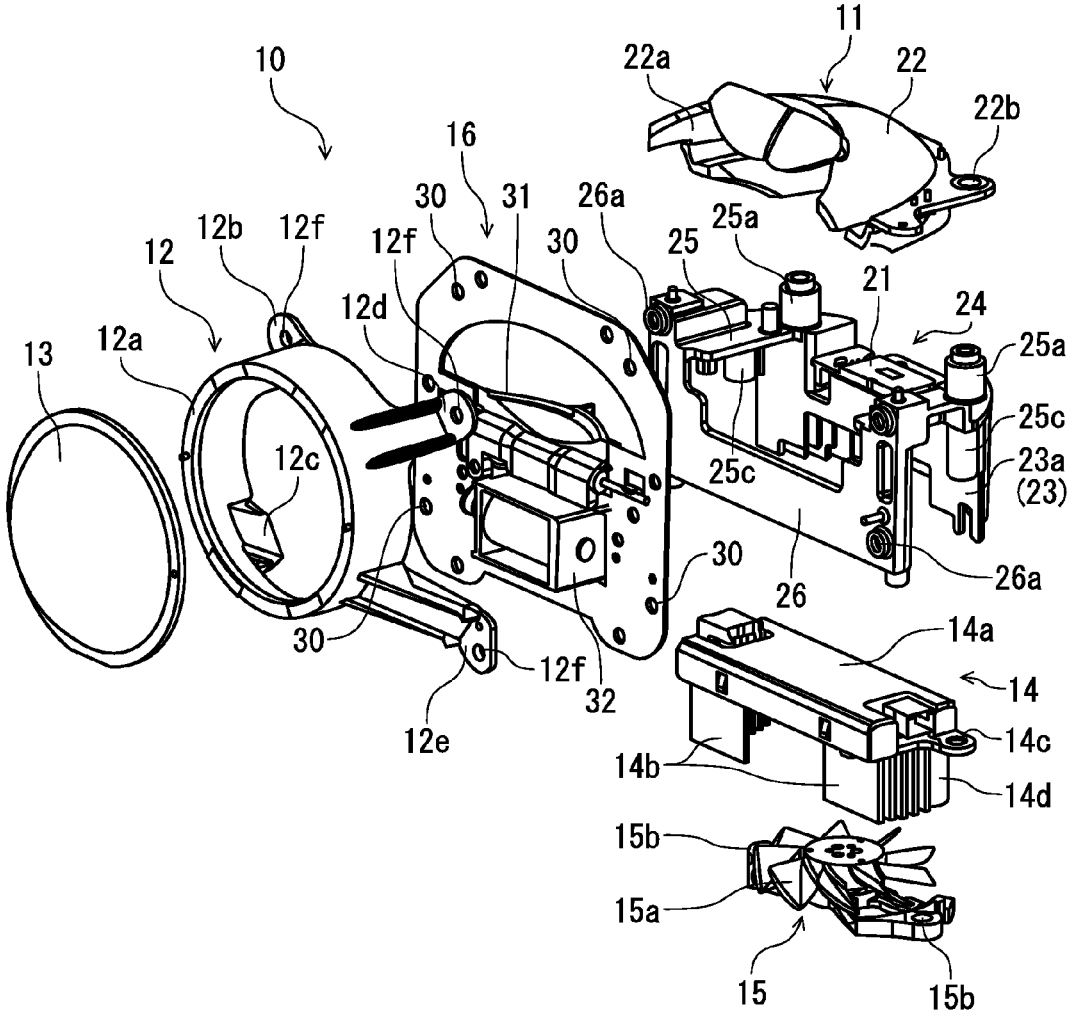
FIG. 3 is an exploded perspective view showing the vehicle lamp of FIG. 1.

FIG. 3 is an exploded perspective view of the lamp unit 10 when viewed from an upper front direction of the lamp.

As shown in FIG. 3, the lens holder 12 includes a lens holding part 12*a*. The lens holding part 12*a* is an annular frame. The projection lens 13 is fixed to a front surface of the lens holding part 12*a*. The lens holder 12 includes an upper-right-side arm 12*b*, a lower-right-side arm 12*c*, an upper-left-side arm 12*d*, and a lower-left-side arm 12*e* which are provided on an opposite-side surface to the lens holding part 12*a*. The upper-right-side arm 12*b* extends rearward from an upper right part of the rear surface of the lens holder 12. The lower-right-side arm 12*c* extends rearward from a lower right part of the rear surface of the lens holder 12. The upper-left-side arm 12*d* extends rearward from an upper left part of the rear surface of the lens holder 12. The lower-left-side arm 12*e* extends rearward from a lower left part of the rear surface of the lens holder 12. Tip end portions of the respective arms 12*b* to 12*e* are formed with engagement holes 12*f*.

The light distribution control unit 16 includes a plurality of engagement holes 30, a movable shade 31, and a solenoid 32. The plurality of engagement holes 30 are provided in an outer periphery portion of the light distribution control unit 16. The movable shade 31 is disposed on an optical axis Ax of the lamp unit 10 at a position in the vicinity (in slightly front) of a rear focal point f of the projection lens 13 (see FIG. 1). The movable shade 31 is configured so as to shield a part of the light reflected by the reflector 22. The solenoid 32 is disposed below the movable shade 31. When a beam changeover switch (not shown) or the like is operated, the solenoid 32 is driven so that the movable shade 31 is moved so as to change a shielding position of the movable shade 31.

Both ends of the reflector 22 in the vehicle right and left directions are provided with a pair of engagement holes 22*b* configured to engage with the light source unit 11.

The attachment part 24 of the light source unit 11 includes an upper wall 25 and a front wall 26.

The light source 21 is mounted at a rear side center portion of the upper wall 25. A pair of protrusion portions 25*a* to be engaged with the pair of engagement holes 22*b* of the reflector 22 are provided on the right and left sides of the light source 21. Engagement of the pair of protrusion portions 25*a* with the pair of engagement holes 22*b* fixes the reflector 22 to an upper portion of the light source unit 11. A pair of engagement parts 25*c* configured to fix the light source control circuit part 14 is provided on right and left sides on a lower surface of the upper wall 25. The heat sink 23 is provided on an opposite-side surface to a surface, to which the light source 21 is attached, of the upper wall 25. The heat sink 23 includes a plurality of heat radiation plates 23*a* extending downward.

The front wall 26 extends downward from a front surface side of the upper wall 25. A plurality of engagement parts 26*a* are formed in an outer periphery portion of the front wall 26. When these engagement parts 26*a* engage with the engagement holes 12*f* of the respective arms 12*b* to 12*e* of the lens holder 12 and the engagement holes 30 of the light distribution control unit 16 and screwed, the lens holder 12 and the light distribution control unit 16 are fixed to the light source unit 11.

The light source control circuit part 14 includes a circuit part 14*a* and heat radiation parts 14*b*. The circuit part 14*a* is provided in an upper portion of the light source control circuit part 14. Then, the circuit part 14*a* houses therein a circuit board (not shown) configured to control the light source 21, the fan 15, and the like. The plurality of heat radiation parts 14*b* extend downward from the circuit part 14*a* and radiate heat generated by the circuit part 14*a*. A pair of engagement holes 14*c* to be engaged with the pair of engagement parts 25*c* of the light source unit 11 are provided on both sides of the light source control circuit part 14 in the lamp right and left directions and between the circuit part 14*a* and the heat radiation part 14*b*. A pair of engagement parts 14*d* configured to fix the fan 15 are provided at rear right and left ends of the heat radiation part 14*b*.

The fan 15 includes a plurality of blade parts 15*a* provided radially. When the fan 15 is driven by the light source control circuit part 14 so as to rotate the blade parts 15*a*, cool air is blown to the heat radiation plates 23*a* of the heat sink 23 and the heat radiation parts 14*b* of the light source control circuit part 14, so that heat radiation efficiency is improved. A pair of engagement holes 15*b* configured to fix the fan 15 to the light source control circuit part 14 are provided on right and left sides of the blade parts 15*a*.

Figure 4:
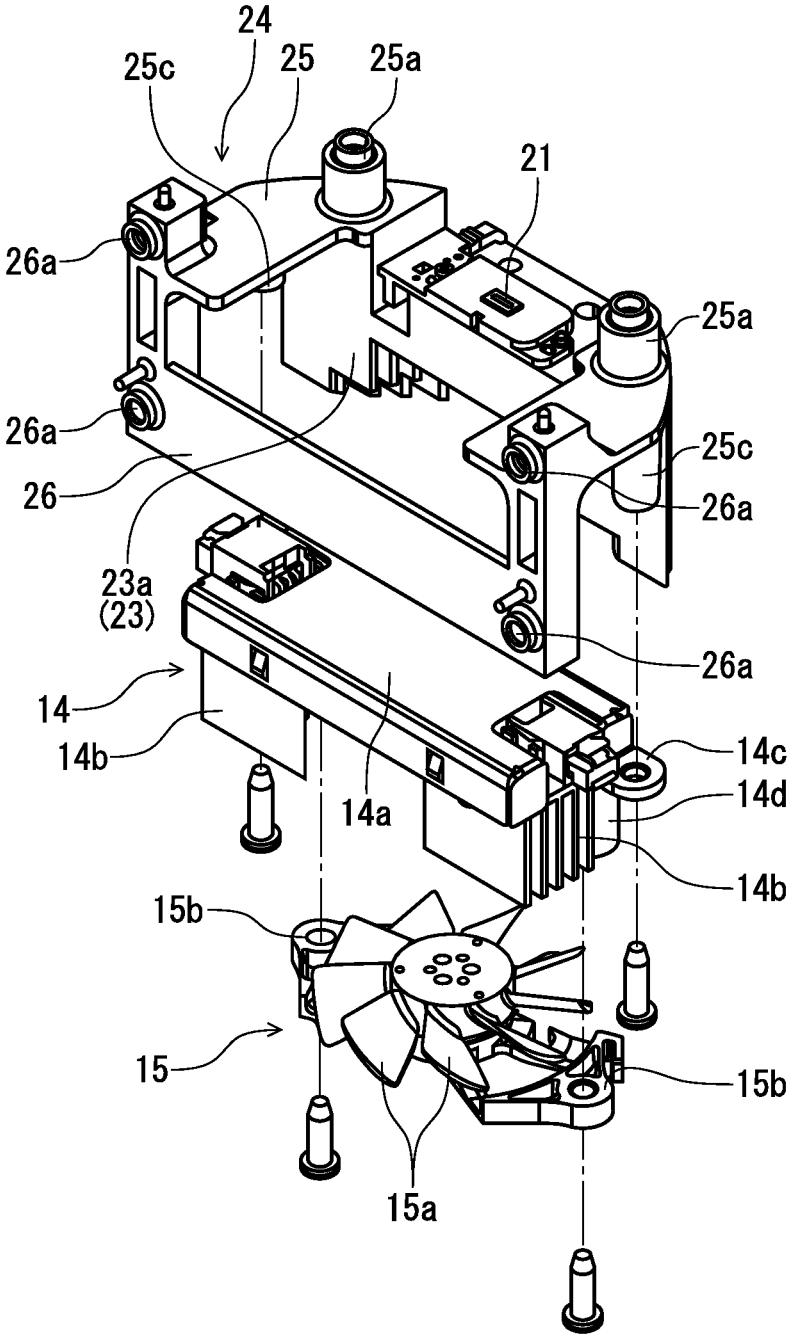
FIG. 4 is an exploded perspective view showing as to how a light source control circuit part of the vehicle lamp of FIG. 1 is attached.

FIG. 4 is an exploded perspective view showing as to how the light source control circuit part 14 is attached.

As shown in FIG. 4, the pair of engagement holes 14*c* of the light source control circuit part 14 are screwed to the pair of engagement parts 25*c* of the attachment part 24, so that the light source control circuit part 14 is fixed to the attachment part 24 from the lamp lower side. Also, the pair of engagement holes 15*b* of the fan 15 are screwed to the pair of engagement parts 14*d* of the light source control circuit part 14, so that the fan 15 is fixed to the light source control circuit part 14 from the lamp lower side. That is, the light source control circuit part 14 and the fan 15 can be attached to the attachment part 24 of the light source unit 11 from the lamp lower side.

As shown in FIG. 1, in the PES type headlight apparatus 1 including the light source 21, the reflector 22, and the projection lens 13, the projection lens 13 is disposed on the lamp front side of the light source control circuit part 14. The light source unit 11 including the light source 21 and the reflector 22 is disposed on a lamp upper side. Also, the heat sink 23 is disposed on a lamp rear side of the light source control circuit part 14. However, according to this embodiment, the light source control circuit part 14 can be attached to the attachment part 24 of the light source unit 11 from the lamp lower side which is a direction where the light source 21, the reflector 22, the projection lens 13 (an example of the optical member), the heat sink 23, and the like are not disposed. Thus, attachment/detachment of the light source control circuit part 14 does not interfere with the light source 21, the reflector 22, and the projection lens 13. Accordingly, even if the light source control circuit part 14 gets out of order, only the light source control circuit part 14 (and the fan 15) can be replaced in a state where the light source 21, the reflector 22, and the projection lens 13 which require a high positioning accuracy are not detached from the lamp unit 10 but remains unitized. Thereby, it is not necessary to disassemble the lamp unit 10 or remove the entirety of the lamp unit 10 from the headlight apparatus 1 in replacement or repair of the light source control circuit part 14, which reduces cost for the replacement or repair of the light source control circuit part 14 and further improves the working efficiency.

Also, according to this embodiment, the lamp body 2 can be opened and closed by the openable part 5 at a portion corresponding to a direction (the lamp lower side in this embodiment) where constituent members of the lamp unit 10 such as the light source 21, the reflector 22, the projection lens 13, and the heat sink 23 are not disposed. Thus, only the light source control circuit part 14 (and the fan 15) can easily be replaced in a state where the lamp unit 10 remains fixed in the lamp body 2.

As for the direction where the members constituting the lamp unit 10 are not disposed, such a configuration may be adopted that the light source control circuit part 14 (and the fan 15) can be attached to and detached from the lamp right or left side rather than from the lamp lower side. In this case, it is preferable that an openable part that can be opened and closed be provided in a portion on the lamp right or left side of the lamp body 2.

Next, a lamp unit 110 according to a modification example of the invention will be described below with reference to FIG. 5. Constituent components that are the same as or similar to those of the lamp unit 10 according to the embodiment shown in FIG. 1 will be designated by the same reference numerals, and redundant description thereon will be omitted.

Figure 5:
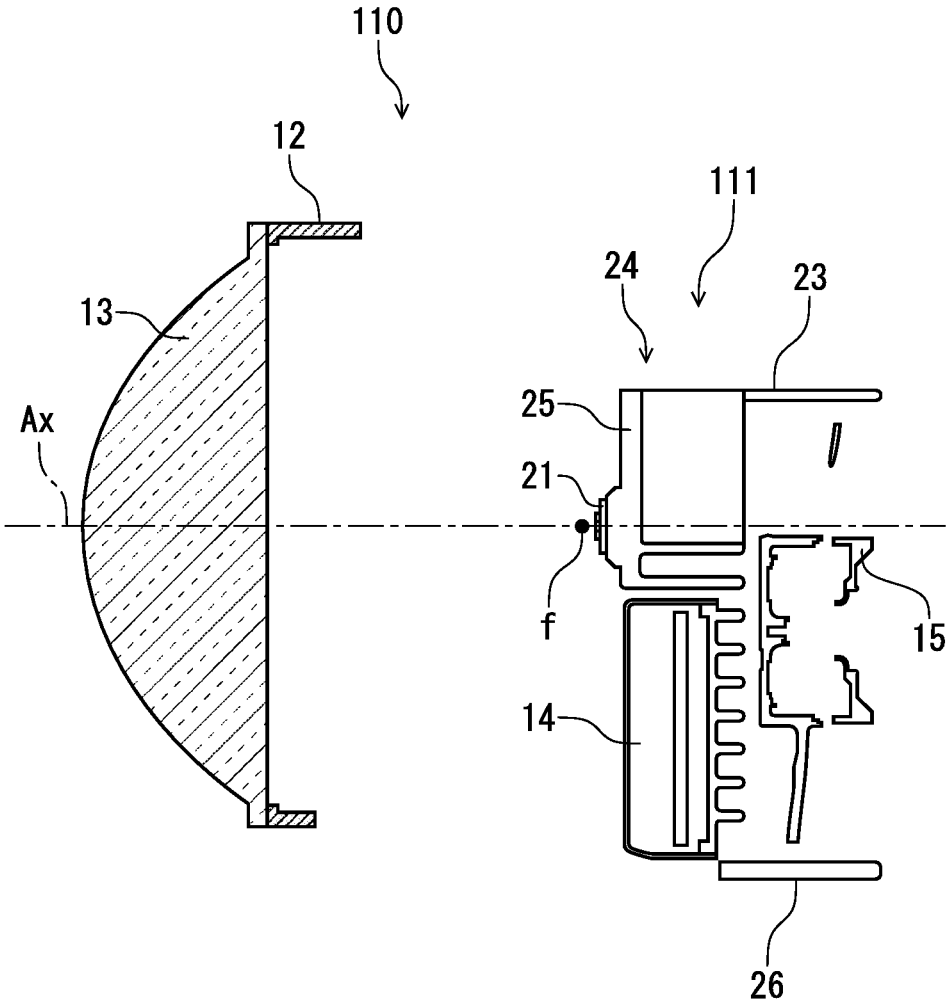
FIG. 5 is a section view of a vehicle lamp according to a modification example of the invention.

As shown in FIG. 5, the lamp unit 110 is a so-called mono-focusing projector type lamp unit and includes a light source unit 111, a lens holder 12, and a projection lens 13. Similarly to the lamp unit 10 shown in FIG. 1, the lamp unit 110 is attached to a lamp body (not shown) from an inner side of a lamp chamber. A light source control circuit part 14 and a fan 15 are attached to the unitized lamp unit 110.

The light source unit 111 includes a light source 21 and a heat sink 23. Different from the embodiment shown in FIG. 1, in this modification example, the light source 21 of the light source unit 111 is disposed on an optical axis Ax of the lamp unit 110 and at a position near a rear focal point f of the projection lens 13. The light source 21 emits light toward a lamp front side. Thus, a reflector 22 is not necessary in this modification example. The heat sink 23 is provided on an opposite-side surface to a surface, to which the light source 21 is attached, of an upper wall 25 of an attachment part 24. The heat sink 23 extends rearward. It is noted that the configurations of the lens holder 12 and the projection lens 13 are similar to those of the embodiment shown in FIG. 1. Also, although not shown, similarly to the embodiment shown in FIG. 1, a light distribution control unit 16 configured to form a plurality of light distribution patterns may be provided between the light source unit 111 and the lens holder 12.

The light source control circuit part 14 is disposed adjacent to the heat sink 23 of the light source unit 111 on the lamp lower side of the heat sink 23. Also, the fan 15 is provided in a space that is located on the lamp rear side of the light source control circuit part 14 and that is formed by a front wall 26 and the heat sink 23 of the light source unit 111.

According to this modification example, the light source control circuit part 14 can be attached to the attachment part 24 from the lamp rear side (the rightward direction in FIG. 5) which is a direction where the light source 21 and the projection lens 13 are not disposed. Thus, similarly to the embodiment shown in FIG. 1, in a case where the light source control circuit part 14 gets out of order, only the light source control circuit part 14 can be detached and replaced or repaired without disassembly of the lamp unit 110. In the lamp unit 110 according to this modification example, it is preferable that an openable part that can be opened and closed be provided on the lamp rearward side of the lamp body (not shown) in order to make only the light source control circuit part 14 (and the fan 15) detachable.

Also, similarly to the embodiment shown in FIG. 1, as for the direction where constituent members of the lamp unit 110 are not disposed, such a configuration may be adopted that the light source control circuit part 14 (and the fan 15) can be attached/detached not only from the lamp rearward side but also from the lamp right or left side. In this case, it is preferable that an openable part that can be opened and closed be provided in a portion on the lamp right or left side of the lamp body.

Next, a lamp unit 210 according to another modification example of the invention will be described below with reference to FIG. 6. Constituent components that are the same as or similar to those of the lamp unit 10 according to the embodiment shown in FIG. 1 will be designated by the same reference numerals, and redundant description thereon will be omitted.

Figure 6:
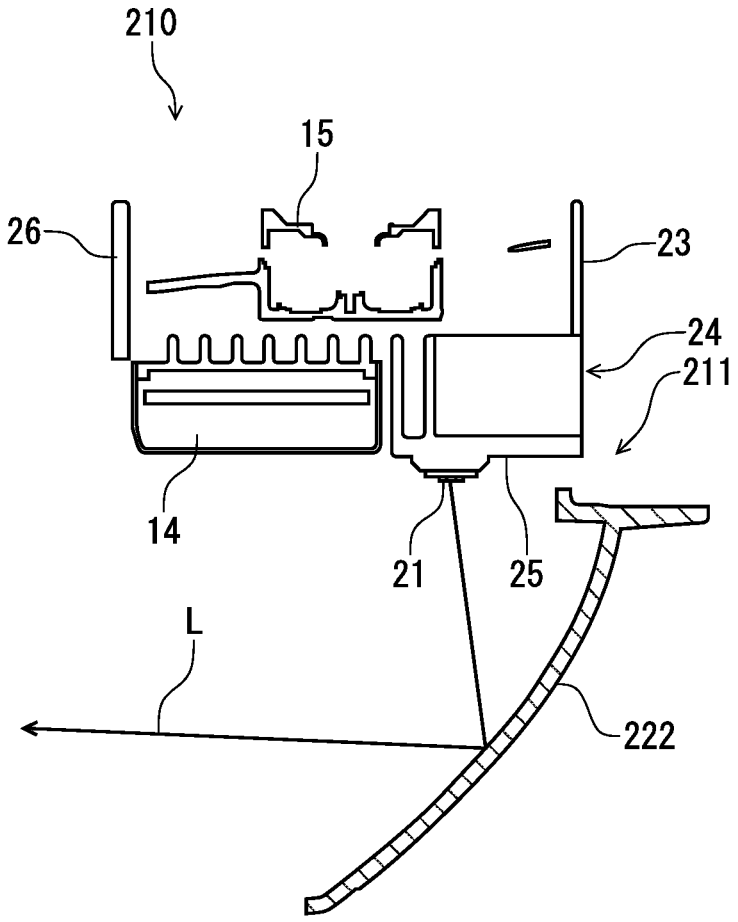
FIG. 6 is a section view of a vehicle lamp according to another modification example of the invention.

As shown in FIG. 6, the lamp unit 210 is a so-called parabola type lamp unit and includes a light source unit 211. Similarly to the lamp unit 10 shown in FIG. 1, the lamp unit 210 is attached to a lamp body (not shown) from an inner side of a lamp chamber. A light source control circuit part 14 and a fan 15 are attached to the lamp unit 210 including the light source unit 211.

The light source unit 211 includes a light source 21, a reflector 222, and a heat sink 23. The configuration of the light source unit 211 is almost the same as that of the light source unit 11 shown in FIG. 1. However, the light source unit 211 is disposed so that the light source 21 emits light L toward a lamp lower side and then the light L is reflected toward a lamp front side by the reflector 222 which is provided so as to cover a lower portion of the light source 21. The heat sink 23 is provided on an opposite-side surface to a surface, to which the light source 21 is attached, of an upper wall 25 of the attachment part 24. The heat sink 23 extends upward. In contrast to the embodiment shown in FIG. 1, in the lamp unit 210, the light L emitted from the light source 21 and then reflected by the reflector 222 passes through a transmissive cover (not shown) and is directly projected onto a forward area of the lamp. Thus, a lens holder and a projection lens are not necessary.

The light source control circuit part 14 is disposed adjacent to the heat sink 23 of the light source unit 211 on a lamp front side of the heat sink 23. Also, the fan 15 is provided in a space that is located on a lamp upper side of the light source control circuit part 14 and that is formed between a front wall 26 of the light source unit 211 and the heat sink 23.

According to this modification example, the light source control circuit part 14 can be attached to the attachment part 24 from the lamp upper side which is a direction where the light source 21 and the reflector 222 are not disposed. Thus, similarly to the above-described embodiment, in a case where the light source control circuit part 14 gets out of order, only the light source control circuit part 14 can be replaced or repaired without disassembly of the lamp unit 210. In the lamp unit 210 according to this modification, it is preferable that an openable part that can be opened and closed be provided on the lamp upper side of the lamp body (not shown) in order to make only the light source control circuit part 14 (and the fan 15) detachable.

Similarly to the above-described embodiment, as for the direction where constituent members of the lamp unit 210 are not disposed, such a configuration may be adopted that the light source control circuit part 14 (and the fan 15) can be attached/detached not only from the lamp upper side but also from the lamp right or left side. In this case, it is preferable that an openable part that can be opened and closed be provided in a portion on the lamp right or left side of the lamp body.

It should be understood that the above-described exemplary embodiments are given by way of illustration only, but do not limit the invention. The invention can be changed or modified so long as changed or modified one is within the spirit of the invention. Also, the scope of the invention includes modifications equivalent thereto.

In the exemplary embodiments described above, the light distribution control unit 16 includes the movable shade 31. However, if there is no need to form a plurality of light distribution patterns using the single light source 21, it is not necessary to provide the light distribution control unit 16.

That is, an illumination apparatus on which the lamp unit 10, 110, or 210 according to the exemplary embodiments of invention is to be mounted is not limited to the headlight apparatus 1. The invention is applicable to a lamp to be mounted on an appropriate vehicle illumination apparatus.

What is claimed is:

1. A vehicle lamp, comprising:
an optical unit comprising:
a light source,
an optical member, and
an attachment part comprising:
a first surface on which the light source is attached,
a second surface on which the optical member is attached, and
a third surface that faces an opposite direction to the first surface, and faces a different direction from the second surface; and
a light source control circuit part,
wherein the light source control circuit part is attachable to the third surface of the attachment part,which faces the opposite direction to the first surface,
wherein the optical member includes:
a lens disposed on a lamp front side of the light source, and
a reflector disposed so as to cover an upper portion of the light source,
wherein a heat sink is provided on an opposite side to the first surface of the attachment part on which the light source is attached, and
wherein the light source control circuit part is disposed adjacent o the heat sink on a lamp front side of the heat sink.

2. The vehicle lamp according to claim 1,
wherein the optical unit and the light source control circuit part are disposed in a lamp chamber formed by a lamp body and a transmissive cover, and
wherein a portion of the lamp body which faces the third surface is openable.

3. The vehicle lamp according to claim 2, wherein a lamp-lower-side portion of the lamp body is openable.

4. The vehicle lamp according to claim 1,
wherein the light source control circuit part is attached to the third surface of the attachment part with a screw that is screwed into the attachment part in a direction perpendicular to the third surface.

5. The vehicle lamp according to claim 1, further comprising:
a lamp body and a transmissive cover which define a lamp chamber,
wherein the optical unit and the light source control circuit part are disposed in the lamp chamber,
wherein one of the lamp body and the transmissive cover is formed with an opening at a portion facing the light source control circuit part attached to the third surface and includes a cover configured to open and close the opening, and
wherein the light source control circuit part is attachable through the opening while the cover opens the opening.

6. The vehicle lamp according to claim 1,
wherein the first surface faces in a direction different from the second surface.

7. The vehicle lamp according to claim 1,
wherein the first surface defines a plane different from the second surface.

8. A vehicle lamp, comprising:
an optical unit comprising:
a light source,
an optical member, and
an attachment part comprising:
a first surface on which the light source is attached,
a second surface on which the optical member is attached, and
a third surface that faces an opposite direction to the first surface, and faces a different direction from the second surface;
a light source control circuit part; and
a fan,
wherein the light source control circuit part is attachable to the third surface of the attachment part, which faces the opposite direction to the first surface,
wherein the light source control circuit part comprises:
a circuit part,
a heat radiation part, and
an engagement part,
wherein the fan is configured to blow air to the heat radiation part, and
wherein the fan is attached to the light source control circuit part via the engagement part of the light source control circuit part.

9. The vehicle lamp according to claim 8, further comprising:
a heat sink disposed on the attachment part on a surface opposite to the first surface,
wherein the fan is further configured to blow air to the heat sink.

10. A vehicle lamp, comprising:

an optical unit comprising:

a light source, an optical member, and an attachment part comprising:

a first surface on which the light source is attached, a second surface on which the optical member is attached, and a third surface which faces a different direction from the first and second surfaces; and a light source control circuit part comprising:

a circuit part, and a heat radiation part, wherein the light source control circuit part is attachable to the third surface of the attachment part, wherein a heat sink is provided on a lower side of the first surface of the attachment part on which the light source is attached, and wherein the light source control circuit part is disposed adjacent to the heat sink such that the heat radiation part is provided on a lower side of the circuit part.

* * * * *